US005181313A

United States Patent [19]

Nonnenmacher et al.

[11] Patent Number: 5,181,313

[45] Date of Patent: Jan. 26, 1993

[54] METHOD OF MAKING A VARIABLE POWER RESISTOR

[75] Inventors: Ronald C. Nonnenmacher, Apache Junction, Ariz.; Kathleen Schulz, Novi, Mich.; Richard C. Lewis, Merrimack, N.H.; Richard Riley, Riverside, Calif.

[73] Assignee: United Technologies Automotive, Dearborn, Mich.

[21] Appl. No.: 818,597

[22] Filed: Jan. 9, 1992

Related U.S. Application Data

[62] Division of Ser. No. 629,885, Dec. 19, 1990, Pat. No. 5,119,063.

[51] Int. Cl.[5] ..... H01C 17/06; H01C 17/28

[52] U.S. Cl. ..... 29/620; 29/621

[58] Field of Search ..... 29/621, 620; 338/159, 338/160, 162, 164, 171, 172; 252/514

[56] References Cited

U.S. PATENT DOCUMENTS 3,206,702 9/1965 Greenwood ..... 29/621
3,838,071 9/1974 Amin ..... 252/514
4,885,434 12/1989 Vultaggio et al. ..... 200/4
5,053,283 10/1991 Brown ..... 428/432

*Primary Examiner*—P. W. Echols
*Attorney, Agent, or Firm*—George J. Romanik

[57] ABSTRACT

A variable power resistor includes a heat sink having a front face and a back face with an electrically insulating, thermally conductive ceramic coating bonded directly onto the front face such that the ceramic coating is in direct thermal contact with the heat sink. A plurality of discrete thick film conductive circuit pads are positioned on the electrically insulating, thermally conductive ceramic coating and a thick film resistive layer is positioned over portions of the conductive circuit pads such that the pads are electrically connected in series. The variable power resistor also includes a moveable contactor capable of contacting the circuit pads in order to vary the resistance of the resistor and an electrical connection between the resistor and an electrical circuit. The electrically insulating, thermally conductive ceramic coating may be plasma sprayed onto the heat sink, while the resistive circuit may be screen printed onto the ceramic coating.

6 Claims, 1 Drawing Sheet

METHOD OF MAKING A VARIABLE POWER RESISTOR

This is a division of copending application Ser. No. 07/629,885 filed on Dec. 19, 1990 now U.S. Pat. No. 5,119,063.

TECHNICAL FIELD

The present invention relates to thick film electrical devices. In particular, it relates to thick film variable power resistors.

BACKGROUND ART

Power resistors are used in many applications to control electrical current or voltage by dissipating electrical power. A resistor may have either a fixed resistance or a variable resistance. Variable resistance power resistors are useful in applications in which the ability to conveniently adjust current flow or voltage is desirable. For example, variable resistance power resistors are used as as dimmer controls in lighting circuits, as components in automobile ignition circuits and test equipment, and in other applications.

All power resistors generate heat when they dissipate electrical power. The amount of heat generated is directly proportional to the amount of power dissipated. The heat must be removed from the resistor to prevent it from overheating and burning out. Heat removal is typically a function of the resistor design, with the rate of heat removal directly proportional to the thermal conductivity of materials used to construct the resistor and the amount of resistor surface area exposed to a cooling fluid. The cooling fluid is typically air.

Heat removal from a resistor can be enhanced by increasing the amount of surface area available for heat transfer. This is often done by adding fins to the resistor or by attaching the resistor to a finned heat sink. However, depending on the design of the resistor, fins can interfere with mechanical elements of the resistor. For example, fins could interfere with the operation of a variable single wire power resistor, which has a mechanical means for varying resistance. A conventional thick film power resistor, however, has a design which is compatible with cooling fins.

A conventional thick film power resistor typically comprises a heat sink attached to a ceramic plate, a thick film resistive circuit deposited or printed on the ceramic plate, and a moveable contactor which facilitates changing the resistance of the device. The heat sink, which may have fins, is typically made from a metal such as aluminum. The ceramic plate serves as an electrical insulator between the resistive circuit and the heat sink. The ceramic plate may be attached to the heat sink with mechanical means such as bolts or a spring clip or with a thermally conductive adhesive. If mechanical means are used, a thermal grease must be used to make thermal contact between the plate and the heat sink. If a thermally conductive adhesive is used, the adhesive itself is sufficient to make thermal contact between the plate and the heat sink.

Conventional thick film power resistors suffer from several drawbacks. First, they can be somewhat cumbersome to assemble. The ceramic plate is fragile and is subject to breakage if dropped during assembly. The plate may also be damaged if mechanical means are used to attach it to the heat sink. The need to use a thermally conductive grease or adhesive to make thermal contact between the plate and heat sink adds an assembly step and material cost. Second, although the ceramic plate is thermally conductive, it contributes a significant thermal resistance between the resistive circuit and the heat sink. The thermally conductive grease or adhesive also contribute a significant thermal resistance. Finally, the thermal grease tends to dry out over time, increasing its thermal resistance and impairing the thermal contact between the ceramic plate and heat sink.

In some environments, for example gas turbine engines, ceramic coatings have been plasma sprayed directly onto a base material to serve as a thermal barrier. Thermally conductive greases and adhesives are not needed with such coatings, and indeed, are incompatible with them. However, because such plasma-sprayed ceramic coatings have been used as thermal insulators, they have not been used in applications where an electrically insulating, but thermally conductive material is required.

Accordingly, it would be desirable to have a thick film variable power resistor which does not not have a breakable ceramic insulator and which does not require a thermally conductive grease or adhesive to conduct heat to a heat sink.

DISCLOSURE OF THE INVENTION

One aspect of the present invention includes a variable power resistor, comprising a heat sink having a front face and a back face with an electrically insulating, thermally conductive ceramic coating bonded directly onto the front face such that the ceramic coating is in direct thermal contact with the heat sink. A plurality of discrete thick film conductive circuit pads are positioned on the electrically insulating, thermally conductive ceramic coating and a thick film resistive layer is positioned over portions of the conductive circuit pads such that the pads are electrically connected in series through the thick film resistive layer. The variable power resistor also includes a moveable contactor capable of contacting the circuit pads in order to vary the resistance of the resistor and means for electrically connecting the resistor to an electrical circuit.

Another aspect of the invention includes a method of making a variable power resistor, comprising plasma spraying an electrically insulating, thermally conductive ceramic coating on a front face of a heat sink followed by screen printing a plurality of discrete thick film conductive circuit pads onto the electrically insulating, thermally conductive ceramic coating. A thick film resistive layer is then screen printed over portions of the conductive circuit pads such that the circuit pads are electrically connected in series through the thick film resistive layer. A moveable contactor capable of contacting the circuit pads in order to vary the resistance of the resistor is also installed.

The foregoing and other features and advantages of the present invention will become more apparent from the following description and accompanying drawings.

BEST MODE FOR CARRYING OUT THE INVENTION

The variable power resistor of the present invention is similar to a conventional thick film power resistor, but dispenses with the separate ceramic plate and thermally conductive grease or adhesive. In their place, the present invention has an electrically insulating, thermally conductive ceramic coating which is bonded directly onto the heat sink, making the heat sink an integral part of the resistor. In addition, a new cermet material is used to make the the resistive circuit compatible with the integral heat sink.

Figure 1:
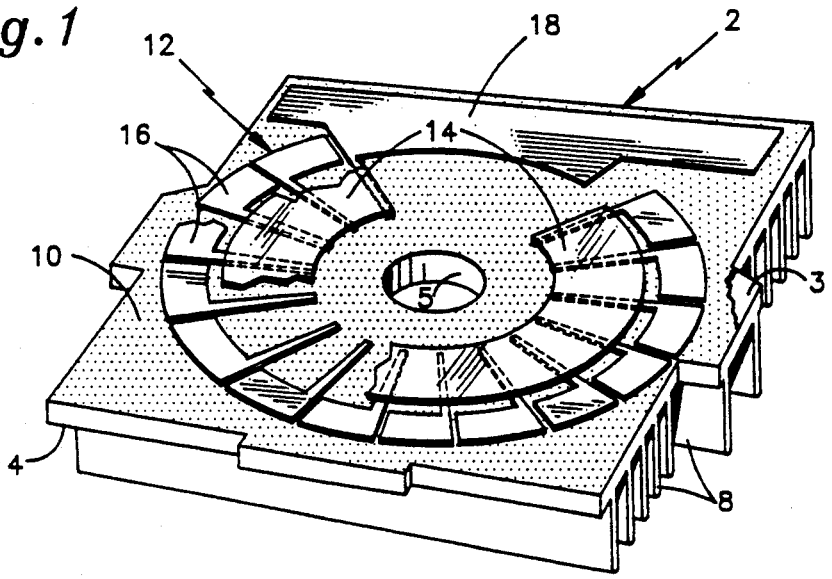
FIG. 1 is a perspective view of the variable power resistor of the present invention.

As shown in FIG. 1, the heat sink 2 has a front face 3, which may be a flat surface, and a back face 4. In addition, the heat sink 2 may have a hole 5 passing from the front face 3 to the back face 4 to facilitate the attachment of the moveable contactor 6, shown in FIG. 2. The heat sink 2 may be made of any material which has a high thermal conductivity, preferably at least about 1.16 Watts per centimeter per degree Kelvin ($W\ cm^{-1}\ K^{-1}$) (65 Btu $hr^{-1}\ ft^{-1}\ °F^{-1}$) at 25° C. (77° F.). Suitable materials include aluminum, copper, and zinc. The preferred material is aluminum. The heat sink may be any shape and size suitable for a particular application. For example, the heat sink may be rectangular or circular, as appropriate.

Preferably, the heat sink 2 will have fins 8 which extend from the back face 4 of the heat sink 2 to increase the surface area available for heat transfer. As is well known in the art, the design of the fins is critical to the rate at which heat can be removed from the resistor. The optimum fin design depends on the material used to construct the fins, the amount of heat to be removed from the resistor, the conditions at which heat is to be transferred, the amount of space available for fins, and other considerations. The preferred design for the variable power resistor of the present invention includes fins which extend from one edge of the heat sink to the opposite edge and have a rectangular cross-section. The dimensions and spacing of the fins are design parameters which depend on the particular application for which the resistor is intended. For example, in a resistor with an aluminum heat sink designed to dissipate 100 watts of power, the fins may be about 0.050 inches (in) thick, about 0.200 in high, and may be spaced about 0.12 in to about 0.14 in apart. A person of ordinary skill in the art would be able to design other fins which would also be suitable.

The electrically insulating, thermally conductive ceramic coating 10 is bonded directly onto the front face of the heat sink 2 so that the ceramic coating is in direct thermal contact with the heat sink. "Bonded directly" means that the ceramic coating is bonded without the use of adhesives, grease, or mechanical means. While the ceramic coating may be any ceramic which can be bonded directly to the heat sink, the preferred ceramic is alumina. The ceramic coating may be bonded directly to the heat sink 2 using conventional plasma spray techniques. For example, the coating may be sprayed with a commercially available plasma spray gun using an argon-hydrogen or nitrogen-hydrogen plasma under conditions recommended by the gun's manufacturer. If alumina is used as the ceramic coating, a Metco 3MB or 7MB gun may be used to apply the coating. The coating serves as an electrical insulator between the resistive circuit and the heat sink 2, which may be electrically conductive. In order to minimize the thermal resistance introduced by the ceramic coating, the coating should be as thin as possible without introducing the possibility of an electric short. A coating of about 0.002 in. to about 0.010 in. would be effective. Preferably, the coating will be about 0.002 in. to about 0.003 in. thick.

The resistor circuit comprises a thick film conductive layer 12, which is positioned on the ceramic coating, and a thick film resistive layer 14, which is positioned over portions of the conductive layer 12. The conductive layer 12 may be screen printed onto the ceramic coating 10 according to conventional thick film techniques to produce a plurality of discrete conductive circuit pads 16. The number of pads will depend on the particular application for which the resistor is designed. The pads may be of any convenient shape and size and may be arranged in any convenient pattern. For example, the pads may be arranged linearly or in an arc. Preferably, the circuit pads 16 will have roughly rectangular bodies, arrayed in an arc around hole 5, with thin rectangular leads extending from the bodies towards the hole 5. At least one of the conductive circuit pads may be substantially larger than the rest to provide an area of zero resistance. This pad, shown as the zero resistance pad 18, may also serve as the electrical contact for current entering the variable power resistor.

The conductive circuit pads 16 and zero resistance pad 18 may be made from a conductive cermet material which comprises a mixture of a metal, such as palladium or silver, reinforcing particles, and a glass. Cermets used with conventional thick film variable power resistors typically fire at temperatures of about 850° C. (1560° F.). However, because the heat sink is an integral part of the variable power resistor of the present invention, the cermets used with the present invention must fire at a temperature below the melting point of the material used to make the heat sink. For example, if the heat sink is made from aluminum, the cermets used for the conductive circuit pads must fire below about 660° C. (1220° F.). One group of conductive cermets which are suitable for use with aluminum and which fire at about 550° C. (1020° F.) may comprise about 10 weight percent (wt. %) to about 70 wt. % of a lead borosilicate glass matrix, about 15 wt. % to about 20 wt. % zirconium spinel reinforcing particles, and up to about 90 wt. % coprecipitated palladium/silver conductive particles in an amount effective to provide a resistance of up to 0.5 ohms/square. Suitable lead borosilicate glasses are available as SG67 from PPG Corporation (Pittsburgh, Pa.) and 2143 from Drakenfield Colors (Washington, Pa.). Suitable zirconium reinforcing particles are available as TAM 51426 Double Silicate from TAM Ceramics, Inc. (Niagra Falls, N.Y.). Suitable palladium/silver conductive particles are available as A-4072 from Engelhard Minerals & Chemical Corporation (Edison, N.J.). The conductive elements should be about 10 microns to about 40 microns thick. Preferably, the conductive elements will be about 25 microns thick after firing.

The conductive circuit pads 16 and zero resistance pad 18 are electrically connected in series by the resistive layer 14 which may be screen printed over the pads 16, 18 using conventional thick film techniques which are well known in the art. The resistive layer 14 is a resistive cermet which comprises a low temperature glass, reinforcing particles, and metals. Like the conductive cermet used for the conductive elements, the resistive cermet must fire below the melting point of the heat sink. For example, the resistive cermet may comprise about 5 wt. % to about 70 wt. % of a lead borosilicate glass matrix, about 15 wt. % to about 20 wt. % zirconium spinel reinforcing particles, and more than about 5 wt. % coprecipitated palladium and silver conductive particles in an amount effective to provide a resistance of greater than to 0.5 ohms/square. The resistance of the resistive cermet can be changed by altering the amount of metal in it. The resistive layer 14 should be about 10 microns to about 40 microns thick and preferably, will be about 25 microns thick. The resistive layer 14 may be a continuous layer which covers a portion of each conductive circuit pad 16, including a portion of the zero resistance pad 18, to form a continuous electrical connection between the pads. A portion of each pad 16, 18 must be left uncovered to permit the moveable contactor 6 to complete an electrical circuit through the pads. The size of the uncovered portion is unimportant, as long as there is sufficient room to make an electrical connection of low resistance. When covered with the resistive layer 14, each of the conductive circuit pads 16 forms a discrete resistor. The resistance of each resistor is determined by the composition of the resistive layer, the distance current must flow through the resistive layer to move from one conductive circuit pad to the next, and by the width of the resistor.

After all of the layers have been deposited on the heat sink, the resistive cermet can be laser or abrasively trimmed according to techniques well known in the art to obtain a desired resistance. The trimming operation entails the removal of a portion of the resistive cermet. Trimming may be required because the cermet may be too thick or the firing conditions may have altered its resistive properties.

Figure 2:
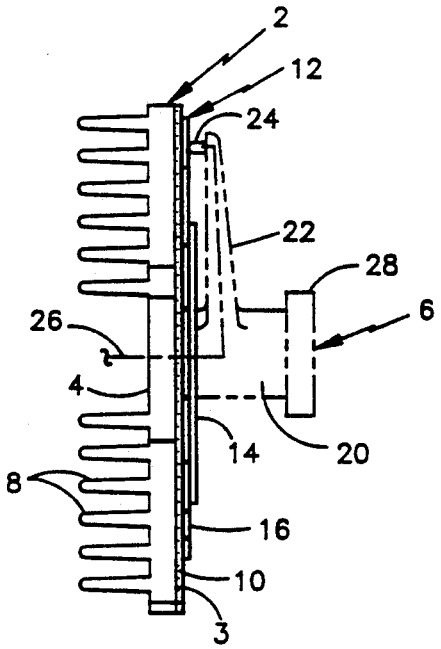
FIG. 2 is an elevation view of the variable power resistor of the present invention.

The moveable contactor 6, shown in FIG. 2, may be any device which permits an electrical contact to be made between the zero resistance pad 18 and any of the conductive circuit pads 16. If the circuit pads 16 are arranged in an arc as shown, the moveable contactor may have a rotatable shaft 20 which fits through the hole 5 in the heat sink 2. An arm 22 may extend from the shaft over the exposed surfaces of the conductive circuit pads 16 and zero resistance pad 18. The shaft 20 and arm 22 may be made of any material, although preferably, at least the shaft will be made from a nonconductive material. Depending on the application, it may be desirable for the nonconductive material to be a high temperature material. A contact 24, which may be electrically connected to means for conducting current out of the variable power resistor 26, makes contact with a selected conductive circuit pad 16 to complete an electrical circuit from the zero resistance pad 18, through the resistive layer 14, and through the selected pad 16. The contact 24 may be a common button-type contact like those found in switches and may comprise nickel-silver, silver-cadmium, silver-copper, or any other suitable material.

Moving the contactor 6 from one conductive circuit pad 16 to another increases or decreases the resistance of the variable power resistor. The resistance selected is determined by the distance the current must flow through the resistive layer 14 to complete the circuit. The lowest possible resistance can be selected by moving the contactor over the zero resistance pad 18. A knob 28 may be attached to the shaft to make movement of the contactor easier. Of course, if the conductive circuit pads 16 are arranged linearly rather than in the arc as shown, the moveable contactor should slide rather than rotate.

Variable power resistors of the present invention can be sized to be compatible with a wide range of applications. For example, depending on the size of the heat sink, a variable resistor of the present invention may dissipate between about 1 watt (W) to about 1000W. The total resistance of the resistor may range from about 1 ohm to about 10,000 ohms. Preferably the total resistance will be between about 10 ohms to about 100 ohms. The resistance across an individual conductive circuit pad is a design consideration and may range from as low as about 0.5 ohms to as high as the total resistance through the resistor. Typically, the total resistance of the resistor will be divided into convenient increments. For example, in a 10 ohm resistor, 10 conductive circuit pads may be provided so that the resistance across each pad is 1 ohm. However, it may be desirable to arrange the conductive circuit pads so that each conductive circuit pad has a different resistance. This would be particularly desirable when each succeeding circuit pad is required to dissipate less power that the one before it as the contactor moves from zero resistance to the maximum resistance. The variable power resistor of the present invention is compatible with voltages of up to at least 240 volts, although it may most frequently be used at the 12 volts common in automobiles.

A variable power resistor of the present invention provides several advantages over conventional thick film power resistors. The use of a plasma-sprayed ceramic coating between the heat sink and resistive circuit facilitates fabrication. The present invention does not have a separate ceramic plate insulator which can break during fabrication and has no need for a thermally conductive grease or adhesive. The fact that the entire resistor is built on top of the heat sink makes assembly easier. In addition the absence of a ceramic plate insulator and thermally conductive grease or adhesive improves heat transfer between the resistive circuit and the heat sink. The plasma-sprayed ceramic coating has a lower thermal resistance than the ceramic plate used in conventional thick film power resistors because it is about 0.020 in thinner than the ceramic plate. Moreover, because the ceramic coating is plasma sprayed directly onto the heat sink there is no thermally conductive grease or adhesive to reduce heat transfer or to dry out over time.

While the present invention is generally directed to a variable power resistor, the combination of a circuit built on a ceramic coating which is bonded directly to a heat sink or other metal substrate has far broader application. For example, other circuits, including hybrid thickfilm circuits which incorporate surface mount devices, could easily be built on top of the ceramic coating. The substrate could serve as a heat sink, a structural element, or as a ground plane as the application dictated.

It should be understood that the invention is not limited to the particular embodiment shown and described herein, but that various changes and modification may be made without departing from the spirit and scope of the claimed invention.

We claim:

1. A method of making a variable power resistor, comprising:

(a) plasma spraying an electrically insulating, thermally conductive ceramic coating on a front face of a heat sink;

(b) screen printing a plurality of discrete thick film conductive circuit pads onto the electrically insulating, thermally conductive ceramic coating, wherein the conductive circuit pads comprise about 10 wt. % to about 70 wt. % of a lead borosilicate glass matrix, about 15 wt. % to about 20 wt. % zirconium spinel reinforcing particles, and up to about 90 wt. % coprecipitated palladium and silver conductive particles in an amount effective to provide a resistance of up to about 0.5 ohms/square;

(c) screen printing a thick film resistive layer over portions of the conductive circuit pads such that the circuit pads are electrically connected in series through the thick film resistive layer, wherein the resistive layer comprises about 5 wt. % to about 70 wt. % of a lead borosilicate glass matrix, about 15 wt. % to about 20 wt. % zirconium spinel reinforcing particles, and more than about 5 wt. % coprecipitated palladium and silver conductive particles in an amount effective to provide a resistance of greater than 0.5 ohms/square; and (d) installing a moveable contactor capable of contacting the circuit pads in order to vary the resistance of the resistor.

2. The method of claim 1 wherein the heat sink comprises a material selected from the group consisting of aluminum, copper, and zinc.

3. The method of claim 1 wherein the electrically insulating, thermally conductive ceramic coating comprises alumina.

4. The method of claim 1 wherein the electrically insulating, thermally conductive ceramic coating is about 0.002 in to about 0.010 in thick.

5. The method of claim 1 wherein the conductive circuit pads are about 10 microns to about 40 microns thick.

6. The method of claim 1 wherein the resistive layer is about 10 microns to about 40 microns thick.

* * * * *

UNITED STATES PATENT AND TRADEMARK OFFICE

CERTIFICATE OF CORRECTION

PATENT NO. : 5,181,313

DATED : January 26, 1993

INVENTOR(S) : Nonnenmacher et al

It is certified that error appears in the above-identified patent and that said Letters Patent is hereby corrected as shown below:

The title page should be deleted to appear as Per attached title page.

Signed and Sealed this

Sixteenth Day of November, 1993

*Attest:*

Bruce Lehman

BRUCE LEHMAN

*Attesting Officer*

*Commissioner of Patents and Trademarks*

United States Patent [19]

Nonnenmacher et al.

[11] Patent Number: 5,181,313

[45] Date of Patent: Jan. 26, 1993

[54] METHOD OF MAKING A VARIABLE POWER RESISTOR

[75] Inventors: Ronald C. Nonnenmacher, Apache Junction, Ariz.; Kathleen Schulz, Novi, Mich.; Richard C. Lewis, Merrimack, N.H.; Richard Riley, Riverside, Calif.

[73] Assignee: United Technologies Automotive, Dearborn, Mich.

[21] Appl. No.: 818,597

[22] Filed: Jan. 9, 1992

Related U.S. Application Data

[62] Division of Ser. No. 629,885, Dec. 19, 1990, Pat. No. 5,119,063.

[51] Int. Cl.[5] ..... H01C 17/06; H01C 17/28

[52] U.S. Cl. ..... 29/620; 29/621

[58] Field of Search ..... 29/621, 620; 338/159, 338/160, 162, 164, 171, 172; 252/514

[56] References Cited

U.S. PATENT DOCUMENTS 3,206,702 9/1965 Greenwood ..... 29/621
3,838,071 9/1974 Amin ..... 252/514
4,885,434 12/1989 Vultaggio et al. ..... 200/4
5,053,283 10/1991 Brown ..... 428/432

*Primary Examiner*—P. W. Echols
*Attorney, Agent, or Firm*—George J. Romanik

[57] ABSTRACT

A variable power resistor includes a heat sink having a front face and a back face with an electrically insulating, thermally conductive ceramic coating bonded directly onto the front face such that the ceramic coating is in direct thermal contact with the heat sink. A plurality of discrete thick film conductive circuit pads are positioned on the electrically insulating, thermally conductive ceramic coating and a thick film resistive layer is positioned over portions of the conductive circuit pads such that the pads are electrically connected in series. The variable power resistor also includes a moveable contactor capable of contacting the circuit pads in order to vary the resistance of the resistor and an electrical connection between the resistor and an electrical circuit. The electrically insulating, thermally conductive ceramic coating may be plasma sprayed onto the heat sink, while the resistive circuit may be screen printed onto the ceramic coating.

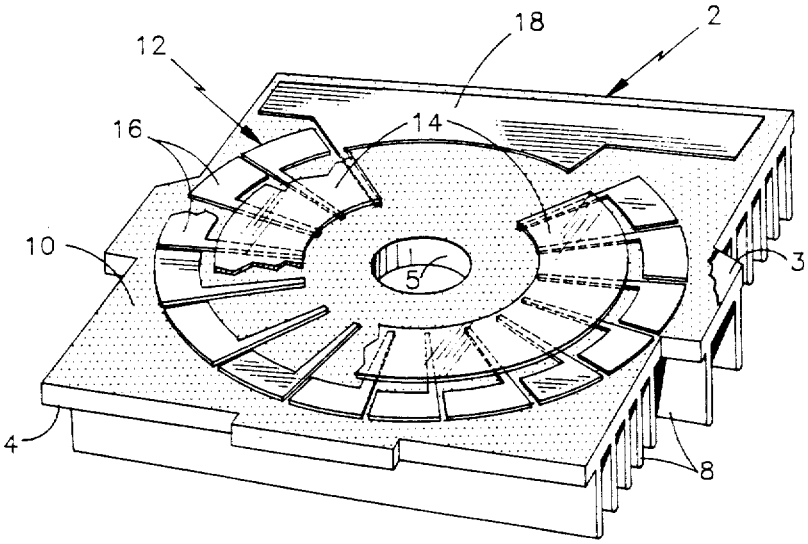

6 Claims, 1 Drawing Sheet